US006102116A

United States Patent [19]

Giovanni

[11] Patent Number: 6,102,116

[45] Date of Patent: Aug. 15, 2000

[54] LOCKING DEVICE TO LOAD AND TO SCREW A DRILL STEM AND CASING TUBES FOR DRILL RIGS

[75] Inventor: Riva Giovanni, Rapallo, Italy

[73] Assignee: Soilmec S.p.A., Cesena, Italy

[21] Appl. No.: 09/063,740

[22] Filed: Apr. 21, 1998

[30] Foreign Application Priority Data

Apr. 22, 1997 [IT] Italy ..... TO97A000340

[51] Int. Cl.[7] ..... E21B 19/16

[52] U.S. Cl. ..... 166/77.51; 166/77.52; 175/203

[58] Field of Search ..... 175/51, 113, 170, 175/171, 173, 162, 203, 230, 256; 166/77.52, 77.53, 206, 242.6, 77.51; 285/39; 294/86.26, 86.28

[56] References Cited

U.S. PATENT DOCUMENTS 3,748,702 7/1973 Brown ..... 188/67

5,645,131 7/1997 Trevisani ..... 175/171

FOREIGN PATENT DOCUMENTS 0525 247 A 2/1993 European Pat. Off. .

TO94A0489 6/1994 Italy .

*Primary Examiner*—H. Shackelford

*Attorney, Agent, or Firm*—Merchant & Gould P.C.

[57] ABSTRACT

A locking device has a lower concave housing suitable to receive and hold an upper end of an element to be attached to a drill stem. The housing forms a conical surface. A number of blocks slides along the conical surface. Each block has an outside sliding surface that is parallel to the conical surface and has an inside surface suitable to engage the elements to be held. The blocks are mounted to slide along the conical surface. The blocks are moveable from a first, free position in which the blocks are pushed toward the lower, outside surface of the conical surface to a second, locked position in which the blocks are radially clamped against the element to be hold.

10 Claims, 4 Drawing Sheets

LOCKING DEVICE TO LOAD AND TO SCREW A DRILL STEM AND CASING TUBES FOR DRILL RIGS

FIELD OF THE INVENTION

The present invention refers, generally, to the field of the drill rigs, in order to realise wells an the likes, wherein drill stems with threaded couplings and/or threaded tubes fro the inside casing of a drill hole are used. In particular, the invention refers to a locking device to load and to screw a drill stem and casing tubes.

DESCRIPTION OF THE PRESENT ART

One of the major problems associated to the well drill rigs is the loading of the drill stem and of the casing tubes; the coupling of the drill rods is particularly critical and it is usually achieved by means of treated connections. The coupling has to be properly done from the point of view of the axial alignment and has to be adjusted in respect to the screwing torque applied during said operation.

It is understood that it is dangerous to use rough and empiric methods to load/screw the drill stems, for instance by executing the lifting with improper auxiliary means, or by applying the clamping force by means of mechanical/hand or chain wrench trusting the operator sensibility, or by executing said operation by means of the motor head itself in direct drive.

In such way there is the risk to obtain improper couplings and to deteriorate the threads of the elements, both in the case of drill stems and of casing tubes.

The Italian patent application no. TO94A000489 discloses a device to load and to screw rods belonging to a drill stem having threaded couplings and threaded tubes for the inner casing of a drill hole, suitable for the use in drill rigs comprising a rotating head suitable to make said drill stem rotate about a substantially vertical axis and slide along said axis. Said device comprises friction means to screw and unscrew drill rods and threaded tubes. Said means comprise a disk, mobile along the vertical direction through the activation of hydraulic pistons, which can rotate together with the rotating head. The disk is provided with a wear pad made of a material with high friction coefficient, said disk is lowered along the vertical direction against the upper end of the last element of the drill stem and it transfers a screwing or unscrewing torque to said element, according to the rotating direction.

The friction couplings have certain limitations whereby the clamping torques have limited application values, which are only partially known; further, the friction devices of this type do not hold safely the drill rod or the tube in the screwing device.

SUMMARY OF THE INVENTION

A purpose of the present invention is to realise a device that will properly connect the threaded elements of the drill stem and that will safely apply a defined and adequate clamping torque on the threads and that will overcome the abovementioned disadvantages.

For this and for other purposes and advantages which will be better understood herein under, this invention has the scope to realise a locking device to screw and to unscrew elements having threaded couplings and belonging to a drill stem or to tubes for the inner casing of a drill hole, suitable for use in drill rigs comprising a rotating head suitable to make said drill stem rotate about a substantially vertical axis and slide along slide axis, characterised by comprising a lower concave housing suitable to receive and to hold the upper end of an element to be screwed or unscrewed into the drill stem in the drill hole; said concave housing forms an envelope of surface divergent in a downward and outward direction in order to allow a plurality of blocks to slide along said envelope of surfaces, each of said blocks has an outside sliding surface, parallel and cooperating with said envelope of surfaces and an inside surface suitable to engage the element to be held; the blocks are mounted in order to slide along said envelope of surfaces and said blocks can have two alternative configurations; a first free configuration, with the locking device in its lifted position, wherein the blocks are pushed by elastic means towards the lower, outside portion of said envelope of surfaces, and a second locking configuration, with the locking device positioned on the element to be held, wherein the blocks are radially clamped against the upper end of said element.

BRIEF DESCRIPTION OF THE DRAWINGS

The structural and functional features of a preferred, but not limiting embodiment of the device according to the present invention will be described with reference to the attached drawings, in which.

DESCRIPTION OF A PREFERRED EMBODIMENT

Figure 1:
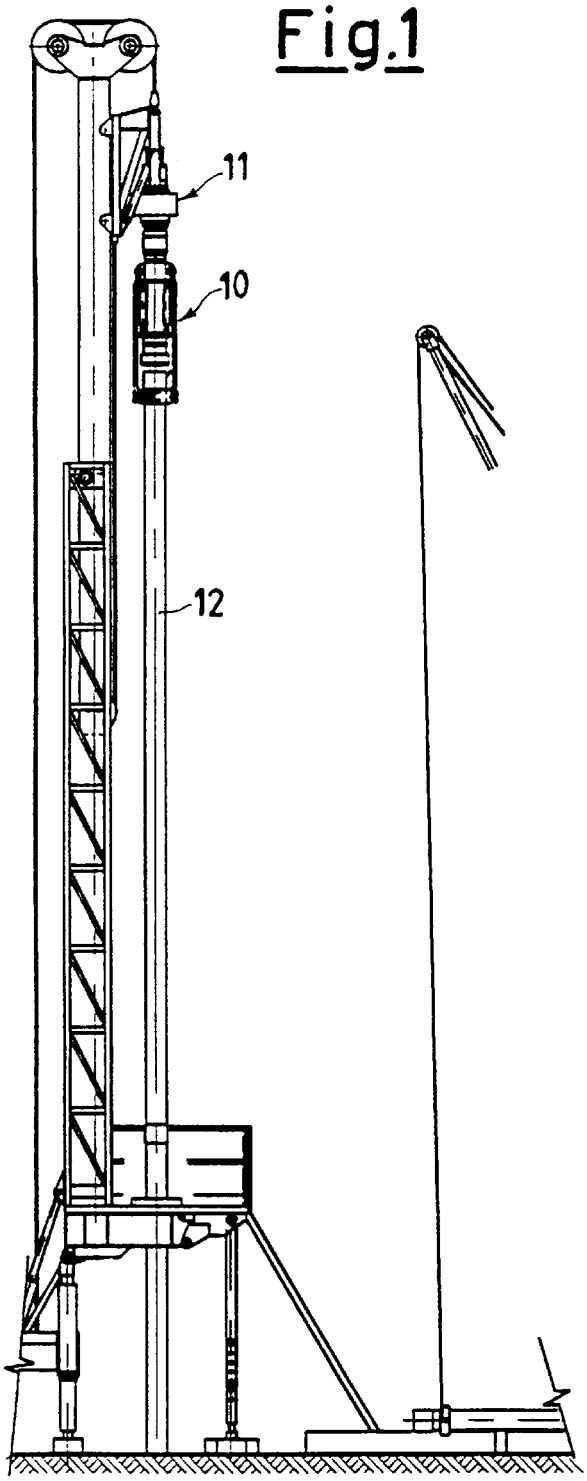
FIG. 1 is a side view of a drill rig having the device of the present invention, during the loading and screwing phase of drill rods or of tubes for the inner casing of the drill hole.
Figure 2:
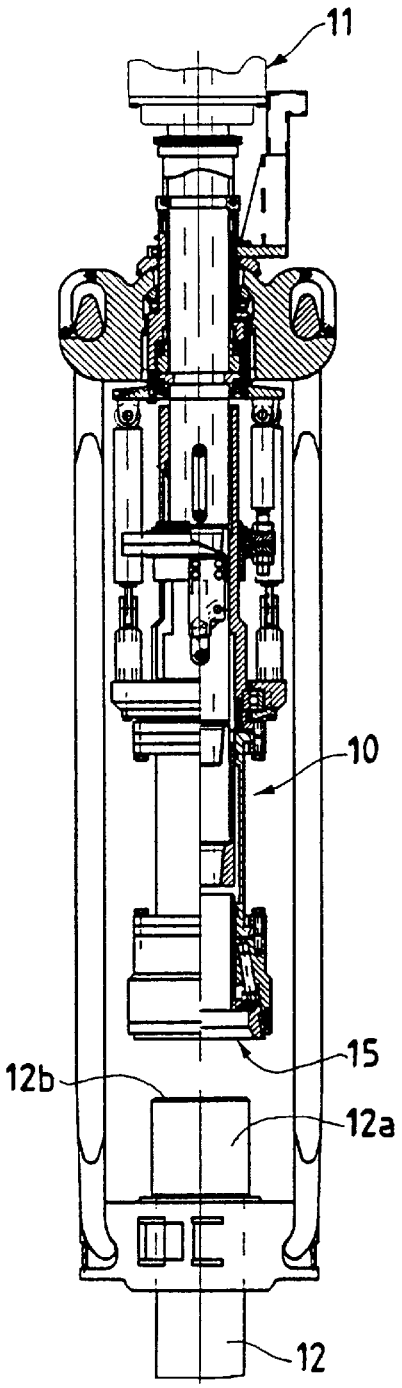
FIG. 2 is an enlarged, partial section view of the device of the invention.

Referring to FIGS. 1 and 2, numeral 10 indicates the locking device according to the present invention. The locking device 10 is connected in a non rotating manner to the rotating drive head 11 of a drill rig of traditional type, said head makes the drill stem or the casing tubes 12 rotate about a substantially vertical axis (the drill axis) and to slide along said axis.

The locking device 10 has the purpose to block, in a releasable way, an element 12 with threadably coupling (drill rod or casing tube) which has to be screwed to or unscrewed from the remaining portion of the drill stem, according to the current working phase.

The locking device 10, by blocking the upper element 12 and by rotating together with the rotating head 11, causes the element 12 to screw or unscrew into the drill stem portion already in place in the drill rig, according to rotation direction received from the rotating head 11.

Figure 4:
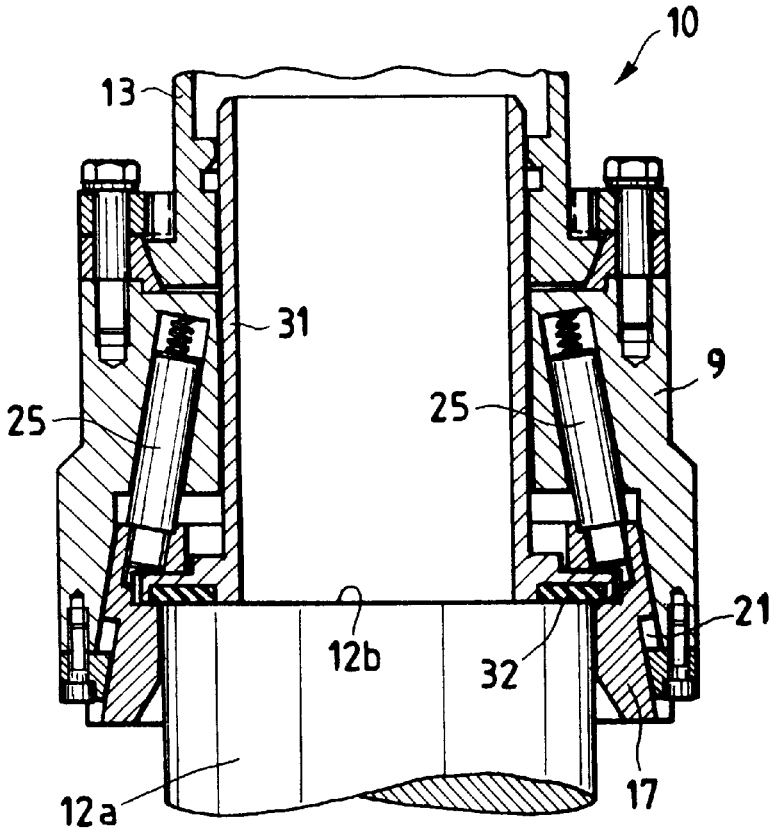
FIGS. 3 and 4 are two axial section views of the device of the invention in two different working configurations.
Figure 3:
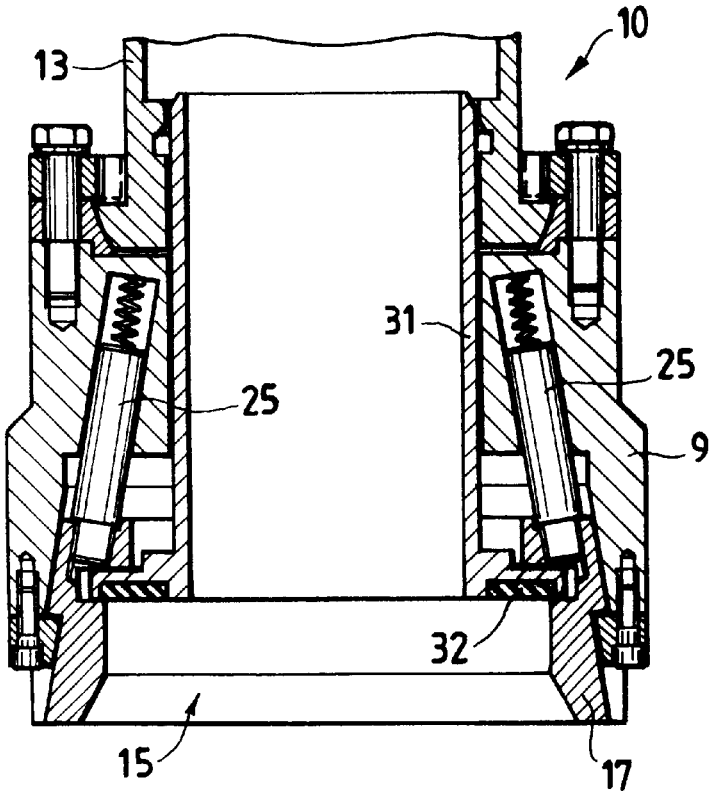
Figure 5:
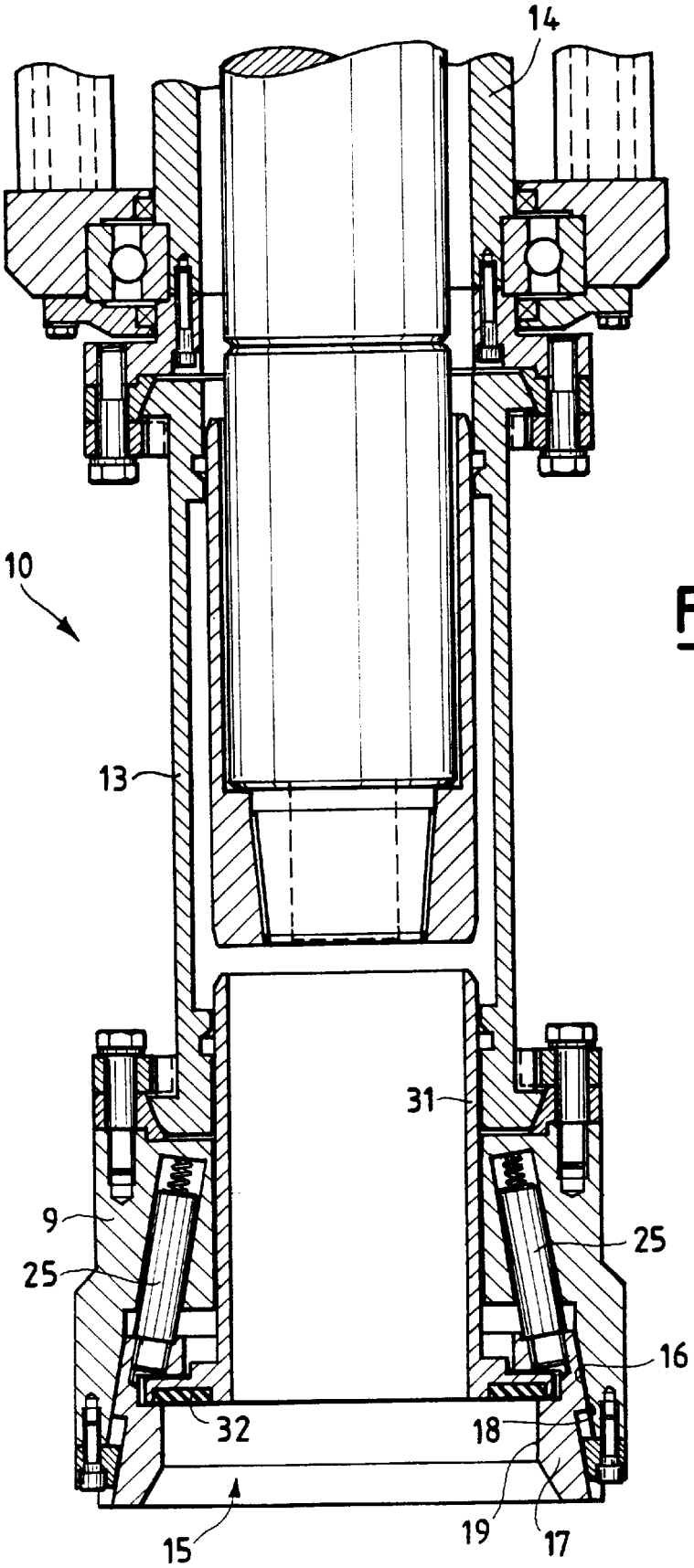
FIG. 5 is an enlarged, partial, axial section view of the device of FIG. 2.
Figure 6:
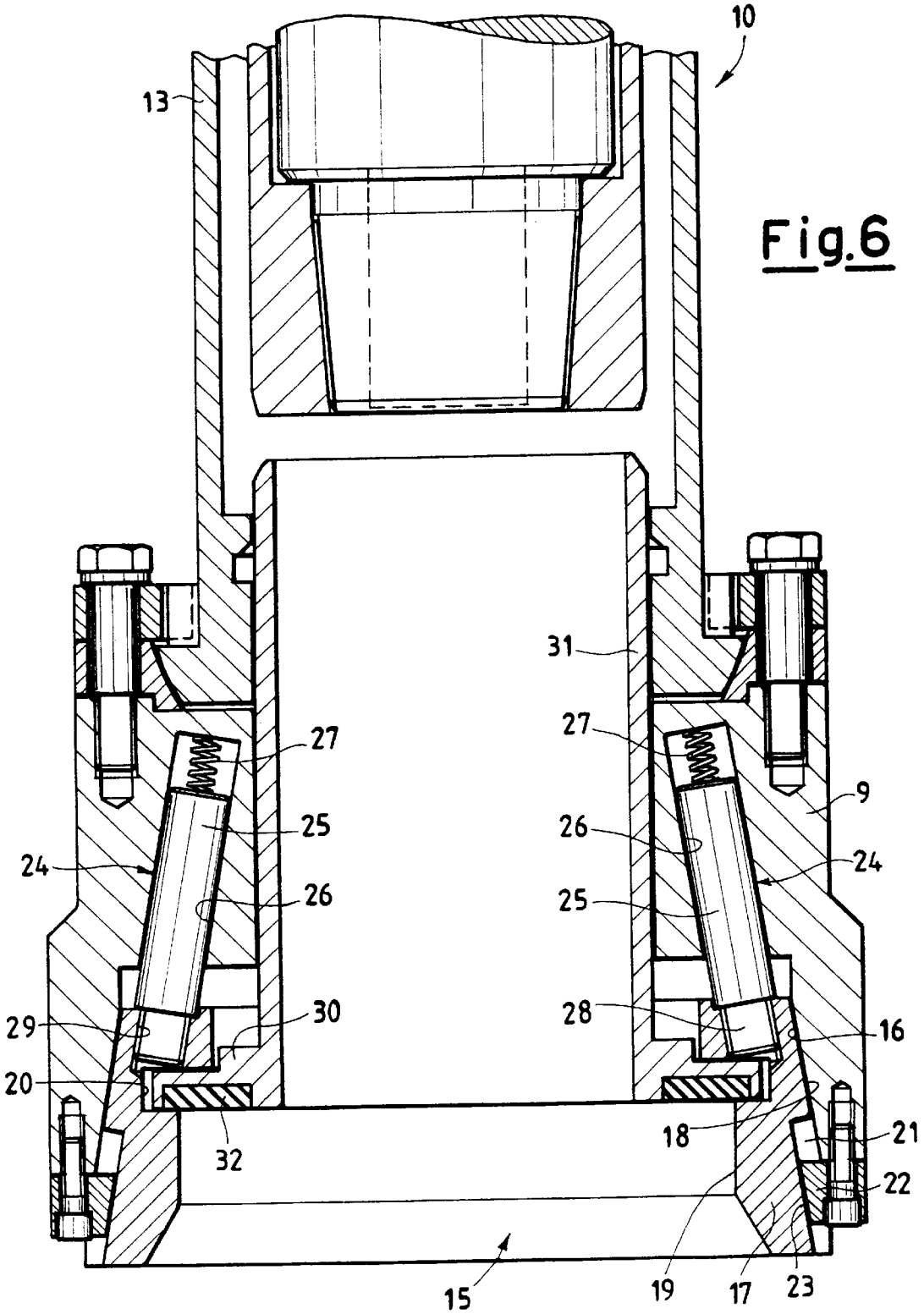
FIG. 6 is an enlarged, partial, axial section view of the device according to the invention.

As shown in FIG. 5, the locking device 10 comprises a bushing 13, drived by the head 11 by means of a further bushing 14 to which it is joined in rotation. Bushing 13 is, instead, joined in rotation to a body 9. As shown in FIGS. 3–5, and particularly in FIG. 6, the body 9 forms a conical inner surface 16, which is divergent in the downward direction. Along the conical surface 16 and inside said surface, a plurality of wedge-shaped blocks 17, suitable to slide along said surface, are mounted, said blocks are adjacent along the circumference direction and each block has an outer lateral surface 18 with a conical shape, congruent with the conical surface 16, and an inner cylindric surface 19 congruent with the lateral cylindric surface of the head 12*a* of the elements 12 of the drill stem. Further, the wedge-shaped blocks 17 form a radial groove 20 sliding in the flange 30 of a further bushing 31 in the body 9; the flange 20 is provided with a frontal seal 32 suitable to go against the upper edge 12*b* of the rod or of the tube 12, as it will be better shown herein under.

In the lower portion of the outer conical surface 18 of each wedge shaped block, a guide or a groove 21 is obtained, said guide is parallel to the conical surfaces 16 and 18 which engage with each other. Each guide 21 slides on a corresponding key or lock 22 integral with the lower portion of the body 9. The keys 22 are mounted in a releasable way to the inlet portion of the conical surface 16 so as to project radically inside the opening defined by said surface. Each key 22 has an inner lateral surface 23 slanting and parallel to the guides or grooves 21 of the blocks 17.

Each wedge-shaped block 17 is coupled with an elastic element, indicated with numeral 24, which pushes the wedge-shaped block in a downward and outward direction along the conical surface 16 of the lower body 9. The elastic elements 24 comprise a piston 25, received in sliding manner in a corresponding cavity 26 obtained in the lower body 9, and pushed downward by a spring 27 biased against the body 9. The lower portion 28 of the piston 25 is fixed, preferably by means of a threaded coupling, in a housing 29 of the corresponding wedge-shaped block 17.

The device operates in the following way: as shown in FIG. 3, in the free or lifted configuration, i.e. before positioning the rotating head on the element 12 to be screwed or unscrewed, the pistons of the elastic elements 24 biased by the springs 27 push the wedge-shaped blocks 17 in a downward and outward direction along the conical surface 16 of the lower body 9. The keys 22, besides guiding the blocks, are also the locking elements which form the lower end run of said blocks. In said lifted configuration, the blocks are evenly spaced along the circumference of the conical surface 23.

When there is the need to screw or unscrew the upper element 12 of the drill stem, the screwing device 10 is lowered vertically on the upper end 12*a* of said element, and is fitted in the cavity 15 between the blocks 17. During its downward motion, the body 9 first brings the flange 30 of the bushing 31 into contact with the upper edge 12*b* of the rod or tube 12; going further downward, the conical coupling defined by the cooperating conical surfaces 18 and 16 progressively push the blocks 17 radially towards the central axis, by making them slide on the upper edge 12*b* of the rod or tube 12. During this movement the groove 20 of the blocks 17 slides along the flange 30 of the bushing 31, which, therefore, acts as a guide for the reciprocal approaching of the blocks 17. The blocks tighten towards the center on the upper portion 12*a* of the element 12 until they lock thereon. Once this locking configuration has been reached (FIGS. 4 and 5), a further push downward by the device 10 clams the element 12 by means of the blocks 17 through a radial compressive force directed towards the center and substantially proportional to the push.

Once the radial pressure required to screw or to unscrew is achieved, the rotating head is rotated in order to transmit to the rod or tube the required screwing or unscrewing torque.

It should be appreciated the fact that the applied locking pressure is precisely determined by adjusting the push force or the downward motion of the rotating drive head. It is possible to transmit locking torques higher than in the past, by safely locking the rod in the screwing device. The locking torque transmitted by the rotating head is therefore precisely adjusted.

The seal 32 of the flange 30, acting over the upper edge 12*b* of the rod 12, allows to reduce to the minimum the interruption of the circulation of the mud during the loading of the rods, producing the necessary frontal seal on the rod during the cycle.

It is understood that the invention is not limited by the herein described and illustrated embodiment, which has to be considered as an example of the device realisation, said invention can, on the other hand, be subjected to changes relative to the shapes and the location of parts, of structural and working details. For instance, the conical surface 16 could be substituted by a plurality of adjacent flat surfaces, forming an envelope of surfaces according to a frustum of pyramid shape, equivalent to the conical surface of FIGS. 3–5, such configuration will obtain results equivalent to the ones described before.

What is claimed is:

1. A locking device to screw and to unscrew elements having threaded couplings and belonging to a drill stem, said device being suitable for use in drill rigs comprising a rotating head suitable to make said drill stem rotate about a substantially vertical axis and slide along said axis, wherein the device comprises a lower concave housing suitable to receive and to hold the upper end of an element to be screwed or unscrewed into the drill stem in the drill hole, wherein said concave housing forms an envelope of surfaces divergent in a downward and outward direction in order to allow a plurality of blocks to slide along said envelope of surfaces, wherein each of said blocks has an outside sliding surface, parallel and cooperating with said envelope of surfaces, and an inside surface suitable to engage the element to be held; the blocks are mounted in order to slide along said envelope of surfaces, wherein said inner surface, having a cylindric shape that is congruent with the lateral cylindric surface of the upper end of the element of the drill stem, cooperates with the horizontal surface of a flange suitable to be pushed against an upper edge of said element, and wherein said blocks are moveable between a first free configuration, with the locking device in its lifted position, in which the blocks are pushed by elastic means towards a lower, outside portion of said envelope of surfaces, and a second locking configuration, with the locking device positioned on the element to be held, wherein the blocks are radially clamped against the upper end of said element.

2. The device of claim 1, wherein said envelope of surfaces forms a conical surface.

3. The device of claim 2, wherein said outer surface, whereon the blocks slide, has the same shape of said conical surface.

4. The device of claim 1, wherein the device is mounted, in a non rotating manner, to the rotating head.

5. The device of claim 1, wherein the blocks are provided with a radial groove sliding over said flange.

6. The device of claim 1, wherein the flange is provided with a frontal seal acting over said head.

7. The device of claim 1, wherein each one of said blocks is coupled with a corresponding elastic means comprising a piston, received in a sliding manner in a corresponding cavity obtained in the device.

8. The device of claim 7, wherein the lower portion of each piston is fixed to the corresponding block through a threaded coupling.

9. The device of claim 1, wherein each one of said outer surfaces of the blocks forms a guide parallel to said envelope of surfaces, a corresponding lock, integral with the device, slides along said guide.

10. The device of claim 9, wherein said locks are bottom locking elements present on said sliding blocks.

* * * * *